US008079685B2

(12) United States Patent
Kanbe et al.

(10) Patent No.: US 8,079,685 B2
(45) Date of Patent: Dec. 20, 2011

(54) INK CARTRIDGES AND METHODS OF MANUFACTURING THE SAME

(75) Inventors: Tomohiro Kanbe, Nagoya (JP); Shingo Hattori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 666 days.

(21) Appl. No.: 11/970,491

(22) Filed: Jan. 7, 2008

(65) Prior Publication Data

US 2009/0058963 A1 Mar. 5, 2009

(30) Foreign Application Priority Data

Aug. 31, 2007 (JP) ..... 2007-225491

(51) Int. Cl.
*B41J 2/175* (2006.01)

(52) U.S. Cl. ..... 347/86; 347/84; 347/85

(58) Field of Classification Search ..... 347/86
See application file for complete search history.

(56) References Cited

U.S. PATENT DOCUMENTS

| | | | | |
|---|---|---|---|---|
| 5,745,137 | A | 4/1998 | Scheffelin et al. | |
| 5,900,896 | A | 5/1999 | Barinaga et al. | |
| 6,257,714 | B1 * | 7/2001 | Seccombe | 347/92 |
| 7,188,939 | B1 | 3/2007 | Sasaki | |
| 7,325,908 | B2 * | 2/2008 | Katoh et al. | 347/85 |
| 2003/0184626 | A1 | 10/2003 | Sasaki et al. | |
| 2004/0130583 | A1 | 7/2004 | Seino et al. | |
| 2005/0168504 | A1 * | 8/2005 | Pan et al. | 347/6 |
| 2006/0033789 | A1 | 2/2006 | Sasaki et al. | |

FOREIGN PATENT DOCUMENTS

| | | | |
|---|---|---|---|
| EP | 1097814 | A | 5/2001 |
| EP | 1772270 | A | 4/2007 |
| EP | 1792736 | A | 6/2007 |
| EP | 1849608 | A | 10/2007 |
| EP | 1886821 | A | 2/2008 |
| JP | 9024698 | A | 1/1997 |
| JP | 9187960 | A | 7/1997 |
| JP | 2005262564 | A | 9/2005 |

OTHER PUBLICATIONS

European Patent Office, European Search Report for Corresponding European Patent Application No. 08003701, mailed on Jul. 3, 2008.

* cited by examiner

*Primary Examiner* — Ryan Lepisto
(74) *Attorney, Agent, or Firm* — Baker Botts L.L.P.

(57) ABSTRACT

An ink cartridge includes a frame, and a film connected to the frame. The frame and the film define an ink chamber therein, and the ink chamber is configured to store ink therein. The ink cartridge also includes a movable member configured to selectively move within the ink chamber based on an amount of ink within the ink chamber, and a spring positioned within the ink chamber. The spring is configured to urge the film away from the movable member in a predetermined direction.

7 Claims, 8 Drawing Sheets

INK CARTRIDGES AND METHODS OF MANUFACTURING THE SAME

CROSS-REFERENCE TO RELATED APPLICATION

The present application claims priority from Japanese Patent Application No. JP-2007-225491, which was filed on Aug. 31, 2007, the disclosure of which is incorporated herein by reference in its entirety.

BACKGROUND OF THE INVENTION

1. Field of the Invention

The present invention relates generally to ink cartridges comprising at least one film which covers an opening of an ink container which is configured to store ink therein, and a movable member which indicates whether an amount of ink stored in the ink cartridge is a sufficient amount of ink.

2. Description of Related Art

A known ink-jet printer is configured to dispense ink onto a sheet of paper to record an image on the sheet of paper. The known ink-jet printer has a recording head. The recording head is configured to selectively eject ink from nozzles to the sheet of paper. A known ink cartridge is configured to be removably mounted to the ink-jet printer. The ink cartridge has an ink chamber configured to store ink therein, and ink is supplied from the ink chamber to the recording head when the ink cartridge is mounted to the ink-jet printer.

The ink cartridge has a movable member disposed in the ink chamber. The movable member is configured to pivot based on the amount of ink stored in the ink chamber. When the ink is consumed and the amount of ink in the ink chamber becomes less than a sufficient amount of ink, an end of the movable member moves from a first position at which the end of the movable member is detected by a detector e.g., an optical sensor, to a second position at which the end of the movable member is not detected by the detector. Consequently, whether the ink chamber has a sufficient amount of ink stored therein may be determined based on the position of the end of the movable member.

It is desirable to reduce the size of the image recording apparatus and the thickness of the ink cartridge. Nevertheless, when the width of the ink cartridge is reduced, an arm and a floating member of the movable member may contact an inner wall of the ink cartridge, which may prevent the movable member from accurately pivoting as ink is consumed. In particular, when the pressure in the ink cartridge is reduced with respect to the atmospheric pressure, the inner wall may deform inwardly and contact the movable member even when the pressure in the ink cartridge is restored to the atmospheric pressure.

SUMMARY OF THE INVENTION

Therefore, a need has arisen for ink cartridges which overcome these and other shortcomings of the related art. A technical advantage of the present invention is that a movable member accurately may pivot as ink is consumed based on the amount of ink in the ink cartridge.

According to an embodiment of the present invention, an ink cartridge comprises a frame and at least one film connected to at least a portion of the frame. The frame and the at least one film define an ink chamber therein. The ink chamber is configured to store ink therein. The ink cartridge also comprises a movable member configured to selectively move within the ink chamber based on an amount of ink within the ink chamber, and a spring positioned within the ink chamber. Moreover, the spring is configured to urge the at least one film away from the movable member in a predetermined direction.

According to another embodiment of the present invention, a method of manufacturing an ink cartridge, in which the ink cartridge comprises a frame, at least one film connected to at least a portion of the frame, an ink chamber defined by the frame and by the at least one film, and a spring positioned within the ink chamber, comprises the step of removing air from the ink chamber to create a pressure differential between a pressure inside the ink chamber and an atmospheric pressure. The pressure differential generates a drawing force which draws the at least one film towards the ink chamber and moves the at least one film from a first position to a second position. The method also comprises the step of applying an urging force via the spring to the at least one film in a predetermined direction away from the ink chamber. The urging force is proportional to the pressure differential and is equal to the drawing force when the at least one film is in the second position.

Other objects, features, and advantages of embodiments of the present invention will be apparent to persons of ordinary skill in the art from the following description of preferred embodiments with reference to the accompanying drawings.

BRIEF DESCRIPTION OF DRAWINGS

For a more complete understanding of the present invention, the needs satisfied thereby, and the objects, features, and advantages thereof, reference now is made to the following description taken in connection with the accompanying drawings.

DETAILED DESCRIPTION OF EMBODIMENTS

Embodiments of the present invention and their features and technical advantages may be understood by referring to FIGS. 1-8, like numerals being used for like corresponding portions in the various drawings.

Figure 1B:
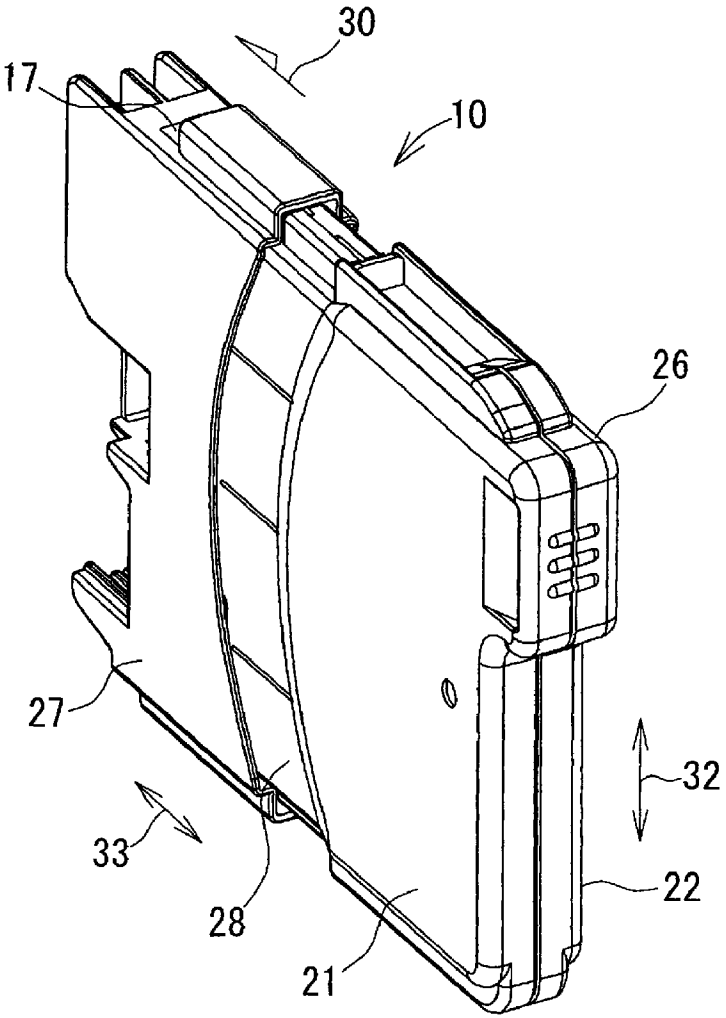
FIGS. 1(A) and 1(B) are a perspective view of a front side and a rear side, respectively, of an ink cartridge 10 according to the present invention.

Referring to FIG. 1, an ink cartridge 10 may be configured to be removably mounted to an ink jet recording apparatus (not shown), such as an ink jet printer. Specifically, ink cartridge 10 may be mounted in a cartridge storage section (not shown) of the recording apparatus when ink cartridge 10 is inserted in a direction of insertion 30.

The ink cartridge 10 may have a substantially flat, hexahedron shape, e.g., a substantially rectangular, parallelepiped shape, and may be more narrow in a widthwise direction, as indicated by an arrow 31, than in a height direction, as indicated by an arrow 32, and a depth direction, as indicated by an arrow 33.

Figure 1A:
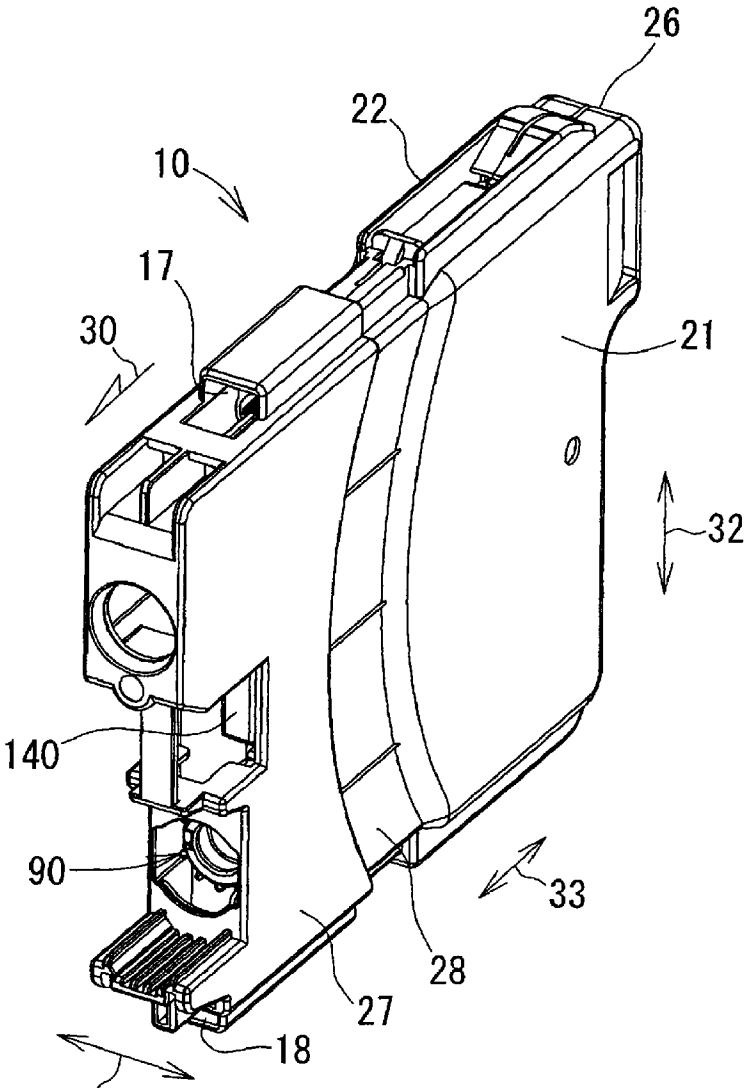
Figure 2:
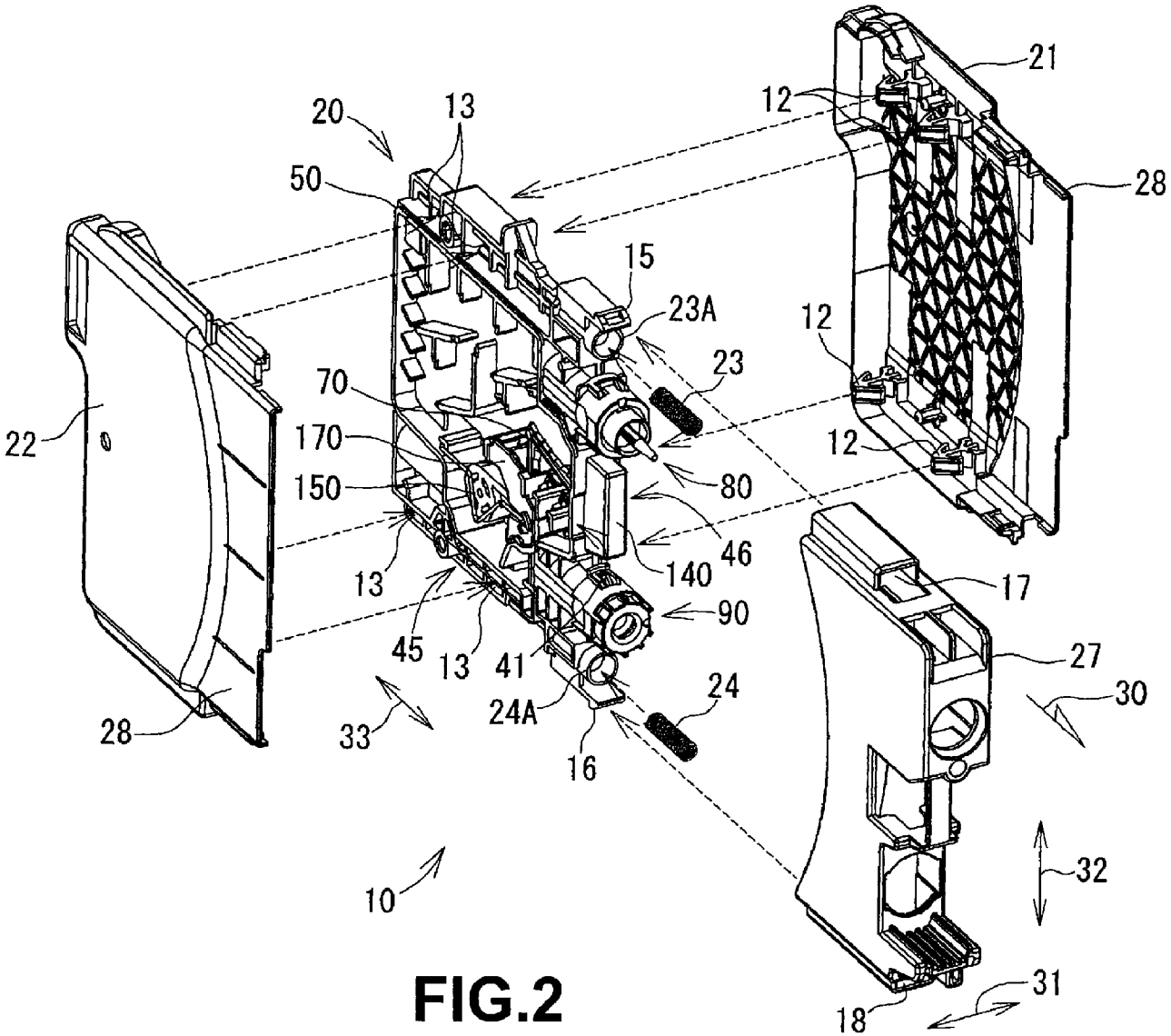
FIG. 2 is an exploded, perspective view of the ink cartridge of FIGS. 1(A) and 1(B).

Referring to FIG. 1(A)-2, the ink cartridge 10 may comprise an ink container 20, a case, e.g., a housing 26, a movable member, e.g., a slider 27, and a pair of coil springs 23 and 24, in which the housing 26 and the slider 27 may form an outer shell of the ink cartridge 10. The ink container 20 may comprise a frame 50, air communication valve 80, and an ink supply valve 90.

The housing 26 may be configured to protect the ink container 20. For example, each portion of the ink container 20 other than a front surface 41 may be covered by the housing 26. The housing 26 may comprise a first cover 21 and a second cover 22 configured to enclose the ink container 20. The first cover 21 may be attached to a right side surface 46 of the ink container 20 via a plurality of engaging claws 12 positioned on the inner surface of the first cover 21, such engaging claws 12 being fitted into engaging grooves 13 formed on the ink container 20. Accordingly, the right side surface 46 of the ink container 20 is covered by the first cover 21. Similarity, the second cover 22 is attached to a left side surface 45 of the ink container 20, such that the left side surface 45 of the ink container 20 is covered by the second cover 22. The covers 21 and 22 may have a shape which allows covers 21 and 22 to avoid interfering with the frame 50, the air communication valve 80, and the ink supply valve 90.

The slider 27 may be attached to the ink container 20 with the coil springs 23 and 24 positioned therebetween, such that the slider 27 may be selectively mounted to and removed from the ink container 20. In an embodiment, the coil spring 23 is mounted to a spring receiver 23A formed at the upper portion of the front surface 41 of the ink container 20, and the coil spring 24 is mounted to a spring receiver 24A formed at the lower portion of the front surface 41. Moreover, the engaging claws 15 and 16 are provided above the spring receiver 23A and below the spring receiver 24A, respectively, and are fitted o engaging grooves 17 and 18, respectively formed on the slider 27. Accordingly, a front portion 28 of the housing 26 is covered by the slider 27.

Figure 3A:
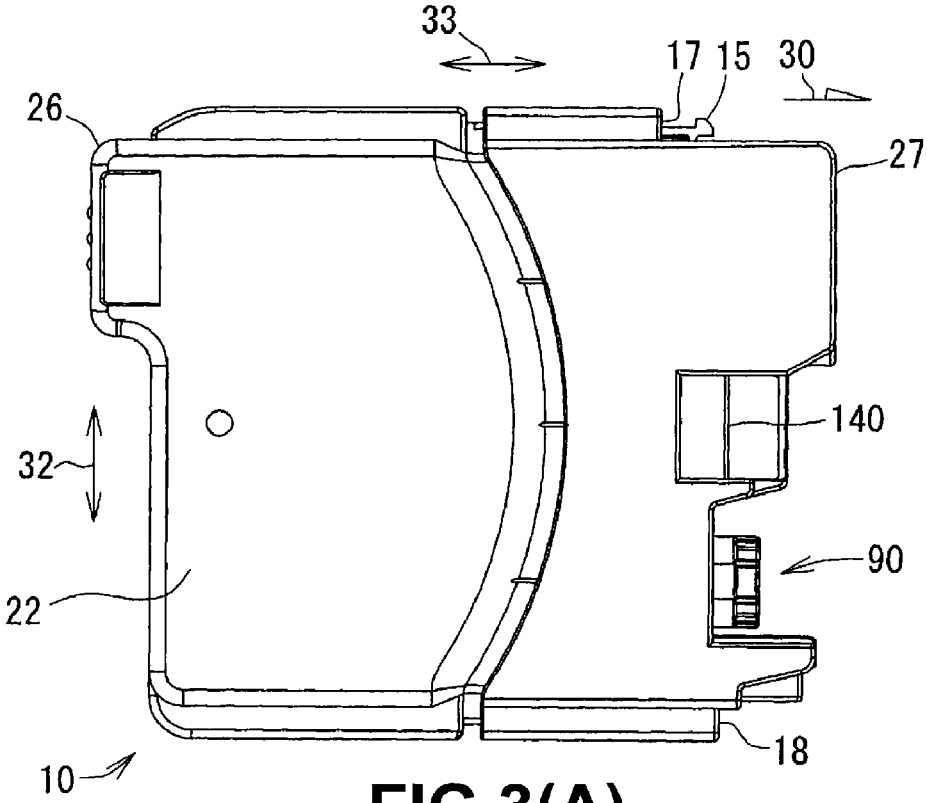
FIG. 3 is a side view of the ink cartridge of FIGS. 1(A) and 1(B).
Figure 3B:
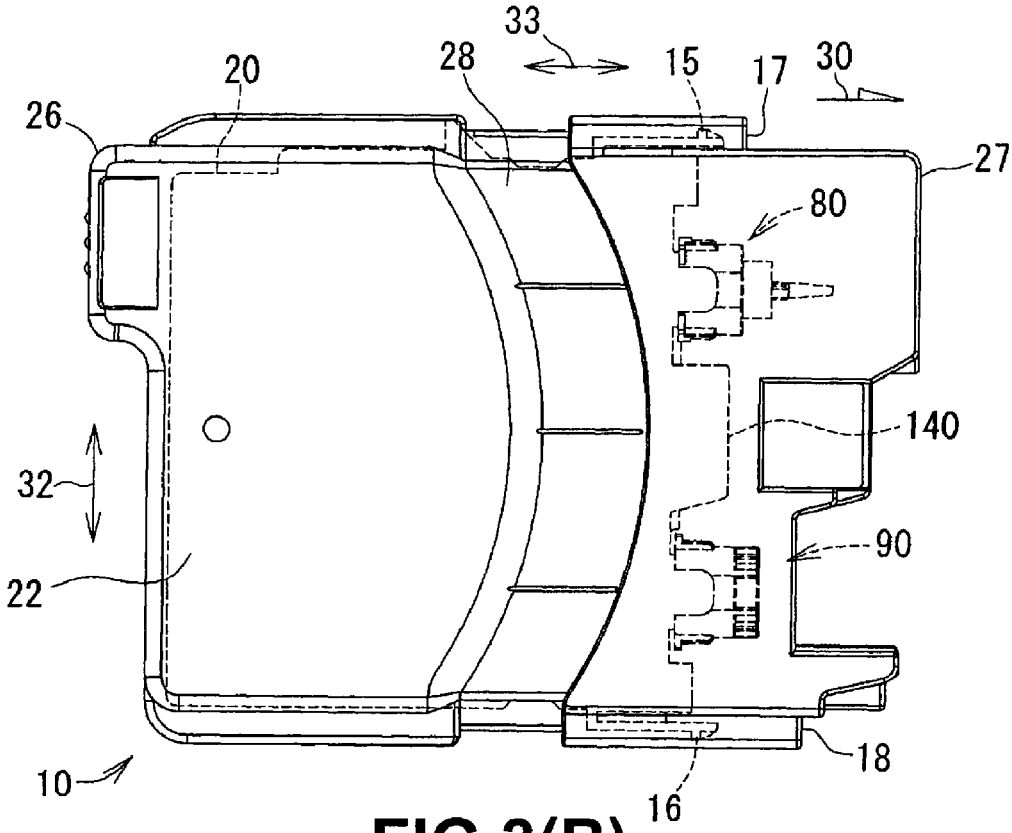
Figure 4:
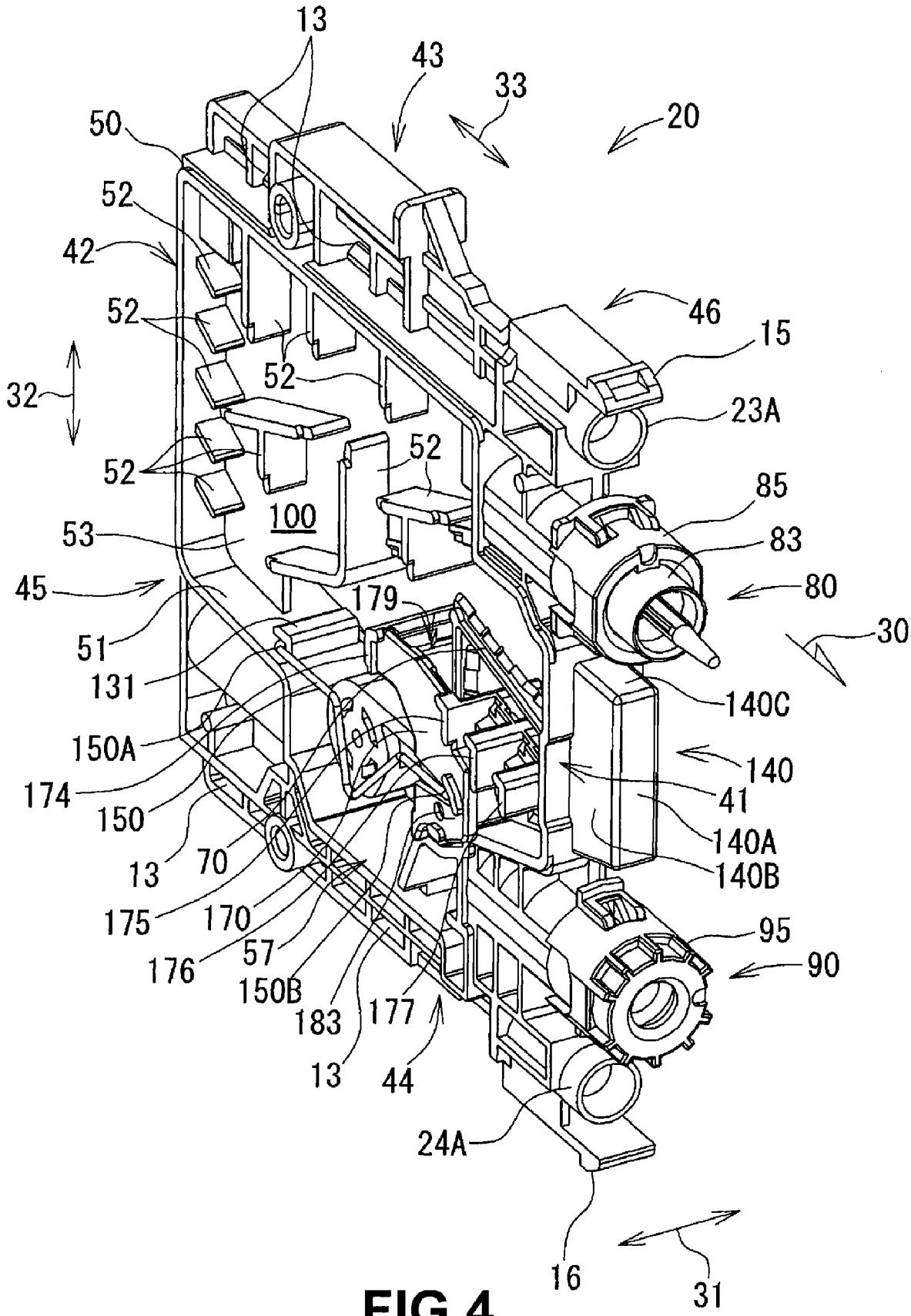
FIG. 4 is an enlarged, perspective view of an ink container, according to an embodiment of the present invention.

In an embodiment, the slider 27 may be configured to slide in the depth direction along the front portion 28 of the housing 26. Referring FIGS. 3(A) and 3(B), slider 27 may be configured to move between a first position, as shown in FIG. 3(B), and a second position, as shown in FIG. 3(A). When the slider 27 is in the first position, the slider 27 may positioned further from the front face 41 than when the slider 27 is in the second position. When the slider 27 is in the second position, the air communication valve 80 and the ink supply valve 90 may be exposed to the outside via a pair of openings formed in the slider 27. When the slider 27 is in the first position, the slider 27 may enclose the air communication valve 80 and the ink supply valve 90.

Referring to FIGS. 4-8, the ink container 20 may have substantially the same contour and shape as the ink cartridge 10. When the ink cartridge 10 is mounted to a cartridge storage section (not shown) of the recording apparatus, the ink container 20 is stored in the cartridge storage section with the slider 27 in the second position. In this embodiment, the ink container 20 may comprise front surface 41, a rear surface 42 opposite the front surface 41, an upper surface 43, a lower surface 44 opposite the upper surface 43, a left side surface 45, and a right side surface 46 opposite the right side surface 45, such that surfaces 41-46 define an enclosure therein. An area of surfaces 45 and 46 may be greater than an area of each of surfaces 41-44.

The ink container 20 may comprise frame 50, an arm 70, a supporting block 170, a spring member 150, the air communication valve 80 the ink supply valve 90, and at least one the film 65, e.g., a pair of films 65, such as a pair of translucent films 65.

The frame 50 may be a housing of the ink container 20 which defines surfaces 41-46. The frame 50 may comprise a translucent resin, e.g., a transparent resin, and may be formed by injection molding. The frame may comprise polyethylene, polyacetal, nylon or the like, or any combinations thereof.

The frame 50 may comprise an outer peripheral wall 51 and a plurality of inner walls 52. The inner walls 52 are disposed inside the outer peripheral wall 51. The outer peripheral wall 51 and the inner walls 52 may be integral with the frame 50. The outer peripheral wall 51 and the inner walls 52 may extend from the left side surface 45 to the right side surface 46 of the ink container 20. The outer peripheral wall 51 may be disposed in an annular shape generally along the front surface 41, the upper surface 43, the rear surface 42 and the lower surface 44 so as to define ink chamber 100 therein. Accordingly, an opening 57 may be positioned on each of the left side surface 45 and the right side surface 46 of the frame 50.

The pair of films 65 may be connected to, e.g., adhered to, the side surfaces 45 and 46 respectively of the frame 50, e.g., thermal adhesion method. More specifically, the films 65 are adhered to both end portions of the outer peripheral wall 51 in the widthwise direction 31. Accordingly, the openings 57 are covered by the films 65, and a space surrounded by the outer peripheral wall 51 and the films 65 is defined as the ink chamber 100. Ink is stored in the ink chamber 100. A pair of the films 65 are provided on the frame 50, such that the films 50 face each other and comprise opposing walls of the ink chamber 100. The opposing walls are opposing walls which are the closest to each other in the ink chamber 100. Alternatively, a box-shaped frame which is opened on one side surface 45 may be employed instead of the frame 50. In this case, the ink chamber 100 is defined by the film 65 adhered on the opened side surface of the frame.

The inner walls 52 may be positioned within a range surrounded by the outer peripheral wall 51. The frame 50 may comprise a partitioning panel 53 which partitions an upper space of the ink chamber 100 at the center in the widthwise direction 31 integrally with the outer peripheral wall 51. The inner walls 52 may be integral with the partitioning panel 53. The films 65 may be adhered to the inner walls 52 at the both end portions in the widthwise direction 31. Accordingly, inward deformation of the films 65 may be prevented or suppressed. Moreover, the first cover 21 and the second cover 22 are deformed inside of the ink container 20, and the inner walls 52 are supported the first cover 21 and the second cover 22. Consequently, the ink container 20 and the films 65 may not be damaged. The lower portion of the ink chamber 100, e.g., a space 102, below the partitioning panel 53 may not be partitioned in the widthwise direction 31.

The film 65 may comprise a plurality of synthetic resin films and may have a multilayer structure. For example, the film 65 may have a three-layer structure having a first layer comprising the same material as the frame 50, a second layer comprising nylon, and a third layer comprising polyethylene terephthalate laminated, such that the first layer on the side of the ink chamber 100 may comprise the same material as the frame 50. Alternatively, the films 65 may comprise a pulp, a metal, a natural resin, or the like.

A bearing plate 74 may be positioned at the center of the outer peripheral wall 51 in the widthwise direction and may protrude therefrom. The bearing plate 74 may be positioned at the outer peripheral wall 51 at a position adjacent to a corner defined by the front surface 41 and the lower surface 44. The bearing plate 74 may be positioned at the end portion in the outer peripheral wall 51 on the side of the right side surface 46, and may protrude therefrom. The bearing plate 74 may be formed with a bearing 67, e.g., a circular bearing, positioned on the surface thereof on the side of the left side surface 45. The shaft 77 may be fitted into the bearing 67, and then a shaft opening 78 of the arm 70 is further fitted on the shaft 77. The other end of the shaft 77 is supported by the supporting block 170.

An ink injection portion 105 may be positioned at the rear surface 42 of the frame 50. The ink injection portion 105 may have a substantially cylindrical hole formed therethrough, which may allow fluid communication between the rear surface 42 and the ink chamber 100. The ink injection portion 105 may be integral with the frame 50 adjacent to the lower end of the rear surface 42. The ink injection portion 105 communicates with the ink chamber 100. Ink is injected into the ink chamber 100 through the ink injection portion 105. A method of injecting ink will be described later.

The front surface 41 of the frame 50 may have translucent portion 140 extending therefrom. The translucent portion 140 may be used to detect the amount of ink stored in the ink chamber 100 visually or optically. The translucent portion 140 may be integral with the frame 50, and may comprise the same material as the frame 50. The translucent portion 140 is irradiated with light by an optical sensor, such as a photo interrupter attached to the recording apparatus. The optical sensor has a light-emitting element and a light-receiving element. In this embodiment, a side wall 140B may be irradiated with light emitted from the light-emitting element and detected light which passes through the side wall 140B may be received by the light-receiving element.

The translucent portion 140 may protrude outward from a portion of the front surface 41 of the ink container 20 adjacent to the middle portion thereof. The translucent portion 140 may be defined by five wall surfaces forming a substantially rectangular shape, and the space 142 may correspond to an interior thereof, and may have a hollow and substantially rectangular box shape. For example, the translucent portion 140 may be defined by a front wall 140A extending in parallel to the front surface 41, a pair of the side walls 140B, an upper wall 140C, and a bottom wall 140D. The width of the front wall 140A may be less than the width of the front surface 41.

The air communication valve 80 may be positioned above the translucent portion 140. The air communication valve 80 may be configured to selectively open and close a through hole 81 to allow fluid communication with the atmosphere positioned on the upper portion of the front surface 41. The air communication valve 80 may comprise a valve body 87, a spring 86, a sealing member 83, and a cap 85. The air communication valve 80 may close the through hole 81 in an air-tight manner when the ink cartridge 10 is not mounted to the recording apparatus and may open the through hole 81 when the ink cartridge 10 is mounted to the recording apparatus. As such, the pressure of an air layer in the ink chamber 100 is equalized with the atmospheric pressure. Alternatively, the air communication valve 80 may be replaced by a film is adhered to the through hole 81, and the film is removed to open the through hole 81.

The ink supply valve 90 may positioned below the translucent portion 140. The ink supply valve 90 may be configured to selectively open and close a through hole 91 to allow ink to be dispensed from an interior of ink chamber 100 to an exterior of the ink chamber 100. The ink supply valve 90 may comprise a valve body 97, a spring 96, a spring receiver 94, a sealing member 93, and a cap 95. The ink supply valve 90 may close the through hole 91 when the ink cartridge 10 is not mounted to the recording apparatus, and may open through hole 91 when the ink cartridge 10 is mounted to the recording apparatus and an ink needle (not shown) applies a force to the ink supply valve 90, such that ink in the ink chamber 100 may be dispensed from the ink chamber 100 to the recording apparatus through the ink needle.

The arm 70 may be used to determine whether the amount of ink stored in the ink chamber 100 is greater than a predetermined, e.g., sufficient, amount of ink. The arm 70 may comprise an indicator portion 72, e.g., a signal blocking portion, which may be positioned at a first end of the arm 70. The indicator portion 72 may configured to be positioned within the inner space 142 or outside of the inner space 142 based on the amount of ink in the ink chamber 100. The arm 70 also may comprise a float portion 73 positioned at a second end of the arm 70.

The arm 70 may have a shaft hole 78 formed therethrough at substantially a center thereof. The shaft 77 may be inserted into the shaft hole 78. The shaft 77 may be configured to rotatably support the arm 70, and may be supported by the bearing 67 (see FIG. 6) positioned on the bearing plate 74 at the first end thereof, and by the supporting block 170 at the second end thereof. The arm 70 may be rotatably supported by the shaft 77 to be pivotable in the first direction and the second direction, which are perpendicular to widthwise direction. The shaft 77 may be separate from or integral with the arm 70.

The interior of the float portion 73 may be hollow, and may float on ink. Alternatively, the float portion 73 may have a specific gravity which is less than the specific gravity of ink. Therefore, the float portion 73 may be displaced upward when the level of ink in the ink chamber 100 is reduced below a predetermined ink level, and the arm 70 rotates according to the displacement of the float portion 73. In this embodiment, the float portion 73 may be configured to allow a second portion 76 from the shaft hole 78 to the float portion 73 to float in the ink.

Figure 5:
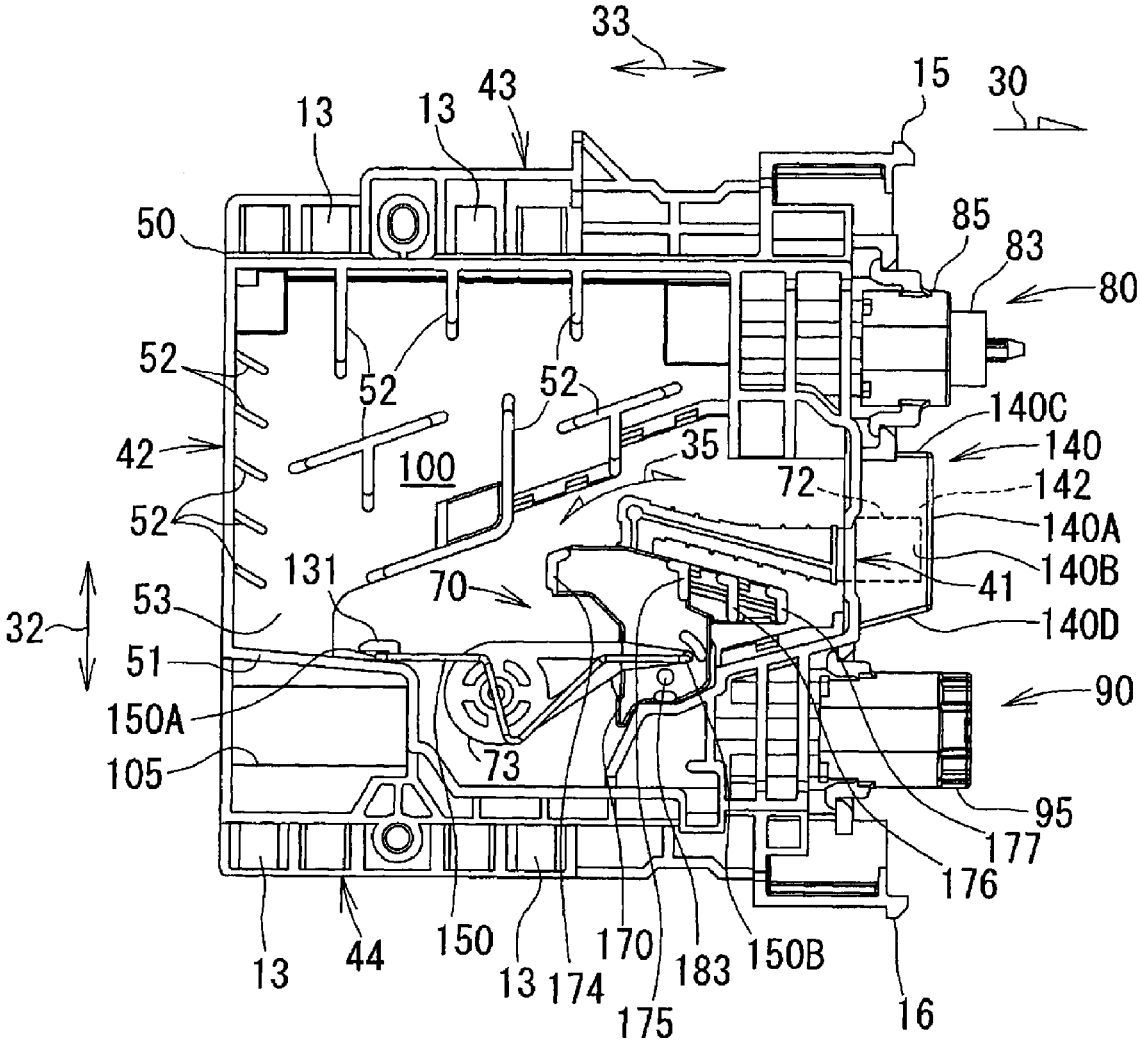
FIG. 5 is a side view of the ink container of FIG. 4.
Figure 6:
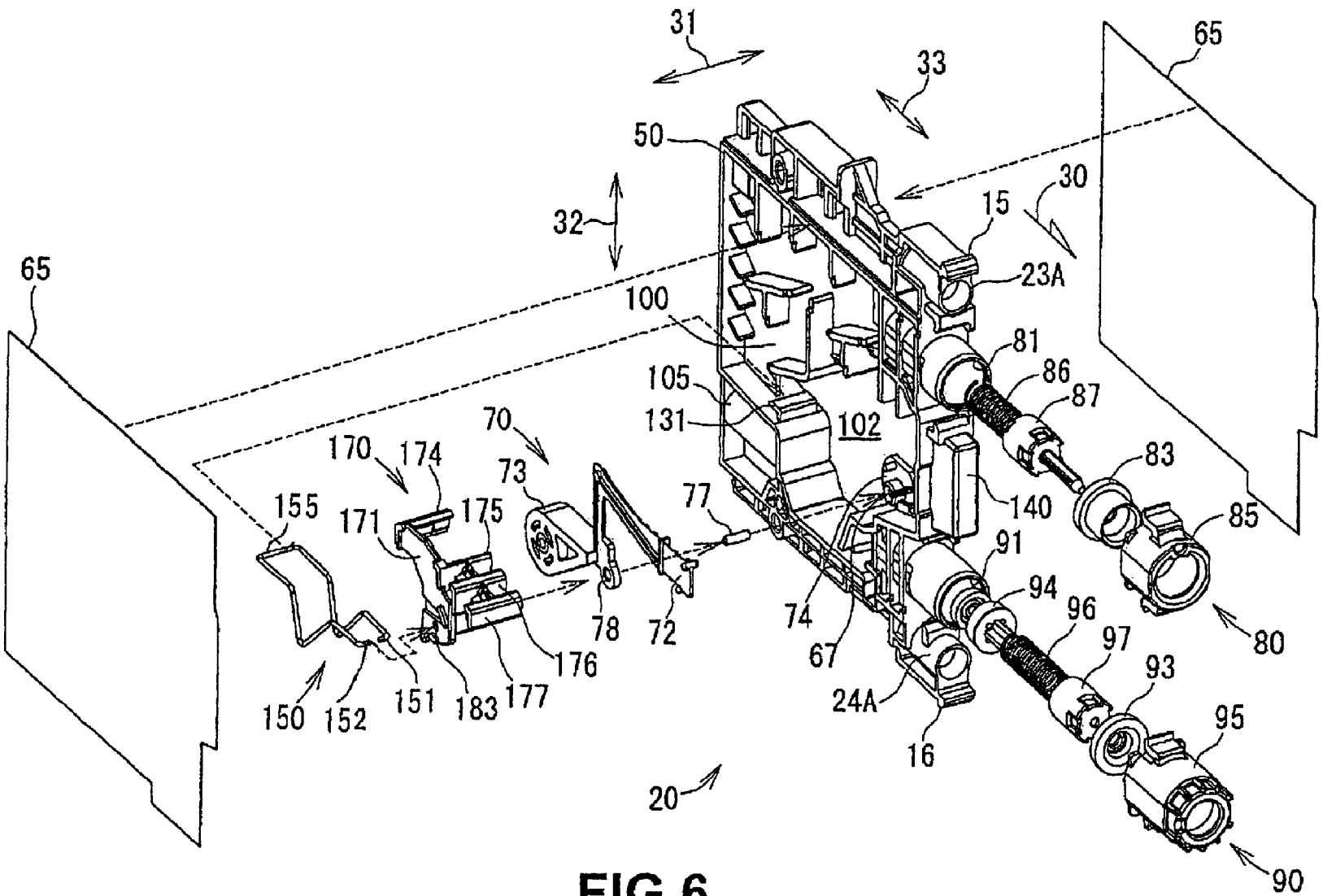
FIG. 6 is an exploded, perspective view of the ink container of FIG. 4.
Figure 7:
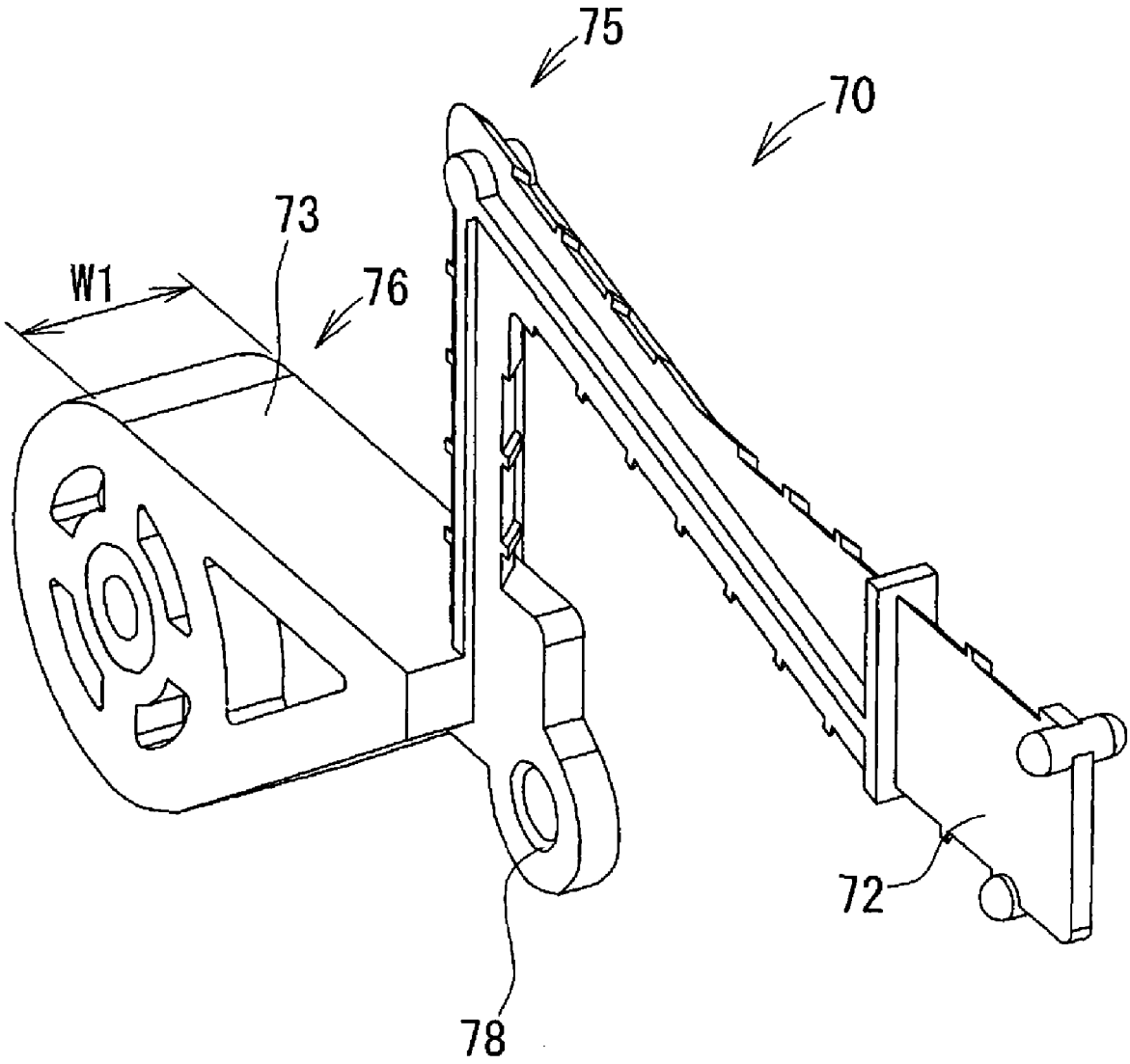
FIG. 7 is a perspective view of an arm, according to an embodiment of the present invention.
Figure 8:
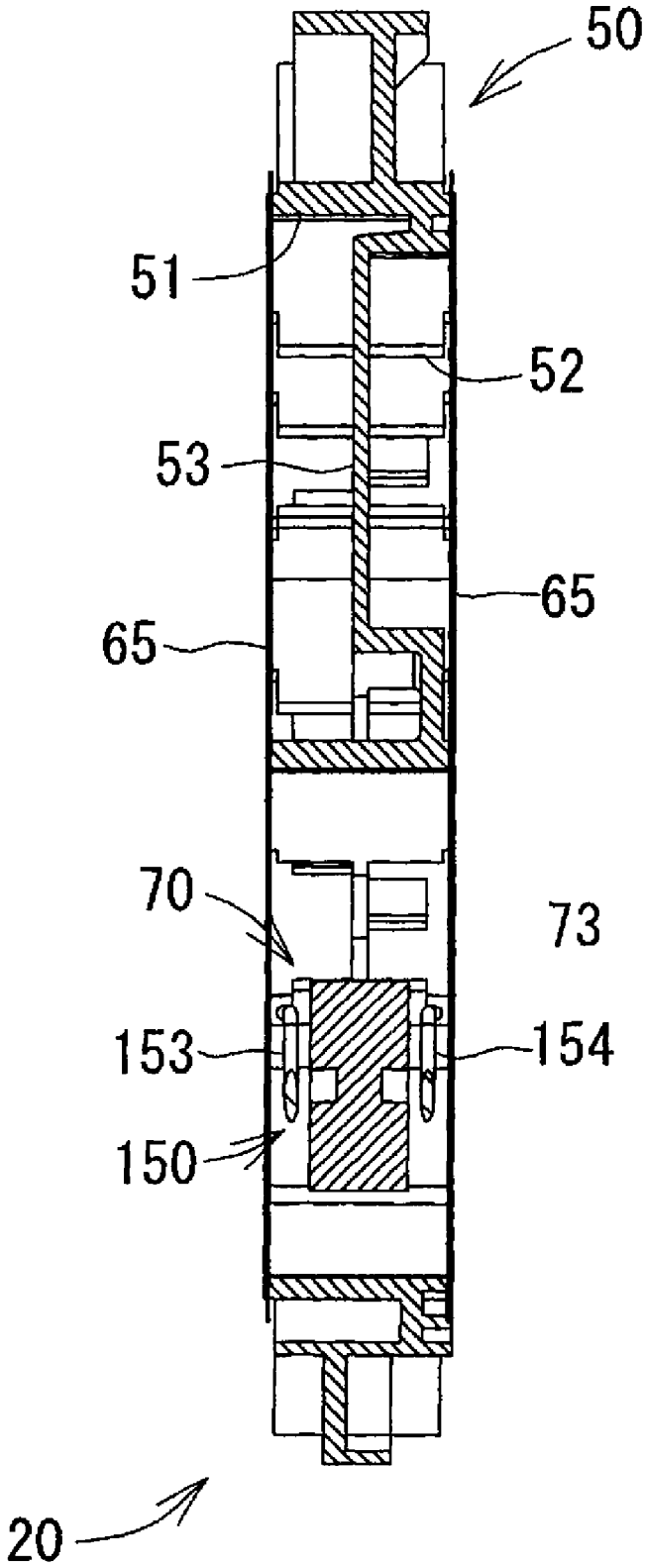
FIG. 8 is a cross-sectional view taken along the line VIII-VIII in FIG. 5.

The indicator portion 72 may be configured to indicate whether the amount of ink remaining in the ink chamber 100 is less than a sufficient amount of ink. When the arm 70 is rotated clockwise, as shown in FIG. 5, the indicator portion 72 moves into the space 142 of the translucent portion 140. The indicator portion 72 then is prevented from further rotation at a first position at which the indicator portion 72 abuts the inner surface of the bottom wall 140D of the translucent portion 140. When the arm 70 is rotated counterclockwise, as shown in FIG. 5, the indicator portion 72 moves away from the bottom wall 140D toward a second position.

In this embodiment, the second portion 76 may have a weight which is greater than a weight of a first portion 75, such that in the air, the second portion 76 is heavier than the first portion 75. Consequently, when the amount of ink within the ink chamber 100 is relatively low, the arm 70 rotates counterclockwise, as shown in FIG. 5, about the shaft 77, and the indicator portion 72 moves out of the space 142 of the translucent portion 140 to indicate that the amount of ink in the ink chamber 100 is less than a sufficient amount of ink.

When the float portion 73 is positioned in the ink, a buoyancy is generated at the float portion 73, and the arm 70 rotates clockwise, as shown in FIG. 5, about the shaft 77. The indicator portion 72 then moves into the space 142 of the translucent portion 140 and is positioned at the first position, which indicates that the amount of ink in the ink chamber 100 is greater than the predetermined or sufficient amount of ink. Alternatively, the arm 70 may be replaced by a floating member (not shown) to provide an indication as to whether the amount of ink in the ink chamber is greater than a sufficient amount of ink.

In an embodiment, the spring member 150 may be attached around the arm 70. The spring member 150 may be fabricated by bending a linear steel member, such as a wire or a line. Alternatively, a leaf spring may be used as the spring member, a coil spring may be provided between the films 65, and a resin member which is resiliently deformable may be employed as the spring member. The leaf spring member may be attached on the outside of the films 65 so as to pull the film outside of the ink chamber. The spring member 150 may comprise end portions 151 and 152, and protecting portions 153 and 154, and a connecting portion 155 and may be fixed to the frame 50 by engaging the connecting portion 155 with a hook 131 formed on the frame 50 and inserting the end portions 151 and 152 into a hole (not shown) positioned on the bearing plate 74 and a hole 183 positioned on the supporting block 170, respectively.

In this embodiment, the protecting portion 153 may be arranged on the side of the left side surface 45 of the frame 50, and the protecting portion 154 may be arranged on the side of the right side surface 46, such that the both sides of the float portion 73 are surrounded by the protecting portions 153 and 154. Because the protecting portions 153 and 154 are bent into a substantially V-shape in the vertical direction, the protecting portions 153 and 154 may be positioned on the both sides of the float portions 73 independent of the position of the float portion 73 which moves based on the movement of the arm 70.

The protecting portions 153 and 154 may be arranged between the float portion 73 and the films 65. In this embodiment, when the films 65 are not deformed inward, the protecting portions 153 and 154 do not come into contact with the films 65. Nevertheless, the protecting portions 153 and 154 are resiliently deformable, such that when the films 65 receive the external force and deform toward the ink chamber 100, the protecting portions 153 and 154 deform resiliently toward the float portion 73 by an external force. When the external force is faded out or dampened, those portions of the films 65 which deflected toward the ink chamber 100 are pushed outward, by a resilient force of the spring member 150. Moreover, the spring member 150 may be configured to push the films 65 apart from each other even when the films 65 are not deformed inward.

A method of manufacturing the ink container may comprise a first step for injecting ink into the ink chamber 100, and a second step for reducing the pressure within the ink chamber 100 to be less than the atmospheric pressure. The arm 70, the shaft 77, the spring member 150, the supporting block 170, the air communication valve 80, and the ink supply valve 90 may be assembled to the frame 50, and the films 65 may be adhered to the left side surface 45 and the right side surface 46 of the frame 50, respectively.

An ink injection portion 105 may be positioned at the rear surface 42 of the frame 50. For example, a nozzle or the like for injecting ink may be connected to the ink injection portion 105 to inject a predetermined amount of ink into the ink chamber 100. The step of reducing the pressure within the ink chamber 100 may be performed before or simultaneously with the step of injecting ink into the ink chamber 100. Specifically, the interior of the ink chamber 100 may be reduced to be less than the atmospheric pressure, e.g., air in the ink chamber 100 may be discharged to reduce the pressure in the ink chamber 100. Subsequently, ink is injected into the ink chamber 100 through the ink injection portion 105 using the pressure differential between the interior and the exterior of the ink chamber 100. The method of injecting ink may be referred to as pressure-reducing injection or vacuum injection. When the pressure in the ink chamber 100 is reduced, dissolution of air into the ink is reduced or prevented, and generation of air bubbles in the ink chamber 100 is reduced or prevented.

After the ink is injected, the air communication valve 80 is closed and the pressure of an air layer in the ink chamber 100 is maintained at a pressure less than the atmospheric pressure. Therefore, the films 65 are deflected toward the inside of the ink chamber 100 by the pressure differential between the interior and the exterior of the ink chamber 100. The housing 26 and the slider 27 may be assembled to the ink container 20.

In the ink cartridge 10, the air communication valve 80 may be opened when it is mounted to the cartridge storage section of the recording apparatus. Accordingly, the gas layer in the ink chamber 100 is drawn into the atmosphere, and the external force which causes the films 65 to deform no longer act on the films 65. Then, those portions of the films 65 which are deflected toward the ink chamber 100 are pushed in the direction away from the float portion 73 by the resilient force of the protecting portions 153 and 154 of the spring member 150. Consequently, in use, the films 65 are prevented from coming into contact with the float portion 73.

When the ink in the ink container 20 is consumed, the ink container 20 again may be filled with ink. When refilling the ink container 20, the second step described above may be omitted. When ink in the ink chamber 100 is consumed, the pressure of ink with respect to the films 65 is also disappeared, and the films 65 may deform toward the ink chamber 100. Nevertheless, as described above, the protecting portions 153 and 154 of the spring member 150 are positioned inside the films 65 and urge the films 65 outward, such that the films 65 do not deform significantly inside of the ink chamber 100 and do not contact the float portion 73. As such, the capacity of the ink chamber 100 is not reduced due to the deformation of the films 65, and the ink chamber 100 readily may be refilled with ink.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or from a practice of the invention disclosed herein. It is intended that the specification and the described examples are consider exemplary only, with the true scope of the invention indicated by the following claims.

What is claimed is:

1. An ink cartridge comprising:

a frame;

at least one film connected to at least a portion of the frame, wherein the frame and the at least one film define an ink chamber therein, and the ink chamber is configured to store ink in the entire ink chamber;

a movable member configured to selectively move within the ink chamber based on an amount of ink within the ink chamber; and a spring positioned within the ink chamber, wherein the spring is configured to urge the at least one film away from the movable member in a predetermined direction;

wherein the at least one film is configured to be drawn towards a center of the ink chamber when an amount of force greater than or equal to a predetermined amount of force is applied to the at least one film in a direction opposite to the predetermined direction.

2. The ink cartridge of claim 1, wherein when no force or a force less than the predetermined amount of force is applied to the at least one film, the spring is configured to urge the at least one film to a predetermined position.

3. The ink cartridge of claim 2, wherein when an applied amount of force greater than or equal to the predetermined amount of force is applied to the at least one film in the direction which is opposite the predetermined direction, the spring is configured to compress until the spring applies an amount of force to the at least one film in the predetermined direction, which is substantially equal to the applied amount of force, and when the applied force is released, the spring is configured to expand to urge the at least one film to the predetermined position.

4. The ink cartridge of claim 1, wherein that the at least one film comprises a first film and a second film which opposes the first film.

5. The ink cartridge of claim 1, wherein the movable member further comprises:

an arm having a first end and a second end opposite the first end; and a float portion positioned at the second end of the arm, wherein the arm is configured to pivot between the first end and the second end of the arm.

6. A method of manufacturing an ink cartridge, the ink cartridge comprising a frame, at least one film connected to at least a portion of the frame, an ink chamber defined by the frame and by the at least one film that is configured to store ink in the entire ink chamber, a movable member configured to selectively move within the ink chamber based on an amount of ink within the ink chamber, and a spring positioned within the ink chamber, the method comprising the steps of:

removing air from the ink chamber to create a pressure differential between a pressure inside the ink chamber and an atmospheric pressure, wherein the pressure differential generates a drawing force which draws the at least one film towards a center of the ink chamber and moves the at least one film from a first position to a second position in a direction opposite to a predetermined direction; and applying an urging force via the spring to the at least one film in the predetermined direction away from the ink chamber, wherein the urging force is proportional to the pressure differential and is equal to the drawing force when the at least one film is in the second position.

7. The method of claim 6, further comprising the step of:

introducing air into the ink chamber to equalize the pressure inside the ink chamber and the atmospheric pressure, wherein after air is introduced into the ink chamber, the urging force applied by the spring moves the at least one film from the second position to the first position.

* * * * *